US005123216A

United States Patent [19]

Kloss et al.

[11] Patent Number: 5,123,216

[45] Date of Patent: * Jun. 23, 1992

[54] PORTABLE GRINDER

[75] Inventors: Günter Kloss; Gustav Schuhmacher; Fritz Gramm, all of Stuttgart, Fed. Rep. of Germany

[73] Assignee: C. & E. Fein GmbH & Co., Stuttgart, Fed. Rep. of Germany

[ * ] Notice: The portion of the term of this patent subsequent to May 1, 2007 has been disclaimed.

[21] Appl. No.: 455,254

[22] Filed: Dec. 22, 1989

Related U.S. Application Data

[63] Continuation of Ser. No. 86,331, Jul. 10, 1987, Pat. No. 4,920,702, which is a continuation of PCT/DE86/-00466, Nov. 15, 1986.

[51] Int. Cl.[5] ..... B24B 23/00

[52] U.S. Cl. ..... 51/170 MT; 51/358; 15/97.1

[58] Field of Search ..... 51/170 R, 170 MT, 170 TL, 51/390, 391, 392, 393, 394, 358; 15/97 R, 22 R, 98

[56] References Cited

U.S. PATENT DOCUMENTS

| | | | |
|---|---|---|---|
| 1,412,725 | 4/1922 | Vernon . | |
| 1,501,192 | 7/1924 | Severns | 51/392 |
| 1,840,254 | 1/1932 | Richardson . | |
| 2,350,098 | 5/1944 | Decker | 51/170 TL |
| 2,469,821 | 5/1949 | Galbraith . | |
| 2,689,436 | 9/1954 | Wagner | 51/170 TL |
| 2,836,940 | 6/1958 | Carmichael | 51/170 TL |
| 3,160,995 | 12/1964 | Danuski | 51/170 TL |
| 3,190,045 | 6/1965 | Zuzelo | 51/209 R |
| 3,443,271 | 5/1969 | Lyons . | |
| 3,619,954 | 11/1971 | Miller | 51/170 |
| 3,892,091 | 7/1975 | Hutchins | 51/170 TL |
| 4,380,092 | 4/1983 | Brothers . | |

FOREIGN PATENT DOCUMENTS

| | | | |
|---|---|---|---|
| 554414 | 6/1932 | Fed. Rep. of Germany . | |
| 886216 | 8/1953 | Fed. Rep. of Germany . | |
| 6935441 | 4/1971 | Fed. Rep. of Germany . | |
| 2262865 | 7/1973 | Fed. Rep. of Germany . | |
| 2742062 | 3/1978 | Fed. Rep. of Germany . | |
| 2365411 | 4/1978 | Fed. Rep. of Germany . | |
| 2741255 | 3/1979 | Fed. Rep. of Germany . | |
| 3012836 | 10/1981 | Fed. Rep. of Germany . | |
| 8426106 | 9/1984 | Fed. Rep. of Germany . | |
| 737766 | 10/1932 | France . | |
| 952683 | 11/1949 | France . | |
| 2420276 | 11/1979 | France | 51/170 TL |
| 2516842 | 5/1986 | France . | |
| 3174 | 1/1981 | Japan | 51/170 MT |
| 276800 | 10/1964 | Netherlands . | |
| 2141620 | 1/1985 | United Kingdom . | |

*Primary Examiner*—Roscoe V. Parker

*Attorney, Agent, or Firm*—Kramer, Brufsky & Cifelli

[57] ABSTRACT

Grinding with known grinders such as corner, belt or vibratory grinders poses insoluble problems, such as the grinding of inner edges set at an angle to each other for example in retainer strips of window and door glasses. A portable grinder has thus been developed in which the grinding or sanding tool (3, 20, 30) effects an oscillatory movement which, unlike in the state of the art, is effected around a fixed axis of the apparatus (29) with a minimum pivoting angle, preferably between 0.5° and with a high pivoting frequency of between ten thousand and twenty five thousand vibrations per minute. This different oscillation movement makes it possible to provide the grinding or sending tool with almost any shape. Furthermore, grinding does not inevitably have to be made with the transverse surface of the tool (3), in particular the perpendicular surface, in relation to the diametrical axis (29) but it is also possible to use a surface which is almost parallel to the first or is even arched. One may also imagine the use of the hole region of the grinding or sanding tool. Preferably, as in the majority of grinders commonly used today, the grinding dust is removed by suction. It is also possible to form in the grinder, in a very advantageous manner, pockets or similar arrangements to contain an abrasive paste for polishing as well as for an emery paste. If emery paper, abrasive material or similar are used, these may be fixed to the tool or exchanged according to a known process or in accordance with the above-described process.

51 Claims, 5 Drawing Sheets

PORTABLE GRINDER

This application is a continuation of application Ser. No. 086,331, now U.S. Pat. No. 4,920,702 filed Jul. 10, 1987, which is a continuation of PCT Application No. PCT/DE86/00466, filed Nov. 15, 1986.

The invention relates to a portable grinder with a drive motor and a grinding or polishing tool oscillatingly driven by it. Such portable grinders are known as so-called vibratory grinders and are widely propagated. They serve, for example, to prepare a surface which is to be subsequently coated with paint or the like. The oscillating plate is driven by means of an electric motor and an interposed eccentric and it usually carries an exchangeable abrasive sheet. The oscillatory motion is either straight-line back and forth or orbital, i.e., in addition, a transverse motion is superimposed on the back and forth motion. In all, the oscillating plate executes a motion of the order of approximately one centimeter which is at least oriented in the longitudinal direction. To avoid damage, the edges at the ends of the oscillating plate must be kept a sufficiently large distance away from further surfaces extending transversely to the workpiece surface which is being worked upon. This is particularly applicable if one of these surfaces is a pane of glass. Such vibratory grinders are, therefore, not usable, or only to an inadequate extent, to grind, for example, glass retaining ledges and inside edges meeting at right angles on window frames. At any rate, grinding right into the corners is not possible.

Apart from the above-mentioned portable grinders with an oscillatingly driven grinding tool, there are also portable grinders with a rotating grinding tool, for example, angle grinders or portable grinders with a circulating grinding tool such as, for example, belt grinders. There are also certain grinding operations, in particular, the grinding of inside edges and inside surfaces which cannot be performed with these portable grinders, or only with unsatisfactory results.

The object underlying the invention is, therefore, to so develop a portable grinder of the kind described at the outset that it can be used to grind surfaces right into converging inside edges or to carry out similar grinding operations which are spatially difficult to perform.

To achieve this object, it is proposed, in accordance with the invention, that a portable grinder be designed with an oscillatingly driven grinding or polishing tool. The principle of the oscillatingly driven grinding or polishing tool, which is advantageous as such, is adhered to in this portable grinder. Instead of the straight-line motion back and forth or the orbital, elliptic-type grinding motion, the grinding or polishing tool of this portable grinder executes a pivotal motion by oscillating about a fixed axis of the apparatus, with the pivot angle being kept relatively small, but the frequency during operation being high. This different type of oscillating motion of the grinding or polishing tool enables the tools to be designed in a completely new way, particularly as far as the working surface of the grinding or polishing tool is concerned. This does, of course, not exclude use of grinding or polishing tools of conventional shape.

Within the scope of the inventive solution, it should be emphasized, in particular, that in one embodiment the grinding or polishing tool may be designed to comprise a corner region tapering to a point, with its side edges including an angle of less than 90 degrees. Hence this corner region preferably enables grinding of corners, which is not possible with the hitherto known grinding tools.

The grinding tool further comprises free side edges adjoining the corner. It is, therefore, also possible to grind inside longitudinal edges with such an inventive grinding tool as the grinding tool can be operated with the side edges adjoining the corner resting against these inside longitudinal edges.

In accordance with the invention, it is highly advantageous for the side edges adjoining the corner to be of convex outwardly bent configuration since such convex bending of the side edges results in the grinding tool resting only in an outermost region of the curve against the inside longitudinal edge and executing with it during its oscillatory motions a movement oriented parallel to this inside longitudinal edge. It can, therefore, be guided along this inside longitudinal edge without being struck away from it, whereas with a straight side edge, the front and rear regions of the side edge would strike perpendicularly against the inside longitudinal edge during an oscillatory motion and hence would also accelerate the grinding tool away from this inside longitudinal edge.

A particularly advantageous further development of the above-described embodiment is obtained, in accordance with the invention, if, in addition, the pivot axis intersects the grinding tool in a central region as the convex side surfaces can then be designed in accordance with the invention such that in their outermost region they do not execute a radial motion with respect to the pivot axis, but merely a motion extending perpendicularly to the radial direction, which makes the grinding tool rest extremely smoothly against an inside longitudinal edge. A further advantage of a pivot axis arranged in a central region of the grinding tool is to be seen in the fact that imbalances and hence vibrations of the entire portable grinder can be avoided.

However, by choosing, for example, a two-edged or preferably a three-edged shape for the grinding or polishing tool, one obtains a grinding or polishing tool with an end region which tapers to a point and thereby also enables grinding of minute surfaces and parts of surfaces. With it, one can also reach into inside edges which meet spatially at right angles, for example, in the corner regions of the panes when old paint is being rubbed down from window frames. By virtue of the high frequency, a high removal rate is achieved, while, in contrast to the vibratory grinder, the minimal pivot angle causes only a minimal deflection motion of the grinding or polishing tool, more particularly, transversely to the fixed axis of the apparatus. With a certain pivot angle, this deflection is, of course, all the smaller, the smaller the distance of the free end of the grinding or polishing tool from this fixed axis of the apparatus. In this way, the deflection of the tool during the oscillatory motion can be influenced by using differently sized grinding or polishing tools. It is readily possible to keep the deflection so small that it is hardly perceivable with the naked eye. One then has the impression that the grinding or polishing tool is not moving at all although it is, of course, performing its work correctly. In this case, neat work can, in fact, be performed right into the inside corner.

When mention is made herein of an axis fixed in relation to the apparatus, this primarily relates to the geometrical axis about which the grinding or polishing tool is pivoted back and forth in the direction of rotation. It will be readily understood that this geometrical axis need not necessarily be arranged centrally in relation to the working surface of the grinding or polishing tool. For example, with a two-edged configuration or the like, a geometrical axis which is offset in the longitudinal direction of the tool has the advantage that oscillation amplitudes of different range are obtained at the two tool ends protruding in the direction of opposite sides. Expediently, however, a pivot of, for example, peg-shaped configuration is provided, on which the grinding or polishing tool is held and whose geometrical axis extends through the apex of the pivot angle.

The oscillating pivotal motion of the grinding or polishing tool can be achieved in a manner known per se with a conventional drive motor, for example, an electric motor and an eccentric driven by it. The drive is, therefore, not illustrated or described in greater detail. The eccentric transfers its rotational motion to a rotatably mounted rocker whose geometrical axis of rotation may at the same time be the geometrical axis for the angular oscillating motion of the grinding or polishing tool. The eccentric engages the end remote from the above-mentioned bearing axis of the rocker, whose longitudinal axis in particular runs approximately parallel to the longitudinal axis of the drive shaft of the eccentric or the drive shaft of the motor. Instead of an electric drive motor, it is, of course, also possible to use any other motor by means of which, for example, such a rocker or a comparable element can be driven in a back and forth pivoting manner.

The previously known vibratory grinders operate with a frequency of the order of ten thousand oscillations per minute. It is expedient to also allow the grinding or polishing tool of the inventive portable grinder to oscillate at least in this order of magnitude. Hence in a preferred embodiment of the invention, the pivoting frequency of the grinding or polishing tool is approximately ten thousand to twenty-five thousand oscillations per minute. This means that with this tool one can go substantially higher with the frequency than in the known prior art. As a rule, however, particularly if the frequency is electronically controlled, one will go to the upper limit of this range with smaller grinding or polishing tools rather than with comparatively larger ones. Also, the high frequencies will be primarily used for polishing. Accordingly, with this portable grinder it is readily possible to polish away, for example, scratches on sensitive windshields which can be caused by the windshield wiper of an automotive vehicle being operated on a dry windshield covered with a layer of dust or grains of sand.

In order not to lose the advantages of this novel type of grinding, the pivot angle should not exceed a certain maximum value with respect to its maximum deflection. In principle, there are no limits in the downward direction. Seen from this viewpoint, it is considered expedient to keep the pivot angle of the grinding or polishing tool within a range of approximately 0.5 degrees to 7 degrees. It is quite conceivable to make the pivot angle alterable, but this involves a certain expenditure.

A particularly preferred variant of the invention is characterized in that a drive shaft comprising or forming the fixed axis of the apparatus is oscillatingly drivable in the direction of rotation by a motor and an interposed gearing. Accordingly, the output shaft of the motor executes a rotational motion, in the usual manner, and, as previously mentioned, it is preferably a high-speed electric motor. The gearing converts this rotational motion into a reciprocating angular pivotal motion of the above-mentioned frequency.

A further embodiment of the invention consists in the grinding or polishing tool being positively connected with the drive shaft, with the drive shaft being, in particular, of polygonal or star-shaped cross-section and the tool comprising a socket or an opening of corresponding cross-section. In this way, a positive connection of the grinding or polishing tool with the oscillating drive shaft is achieved which, on the one hand, can contend with the stresses which occur and, on the other hand, enables simple and quick exchange of the tool.

In an axially symmetrical or centrally symmetrical design, the grinding or polishing tool is preferably arranged concentrically with the drive shaft. As the drawings show, it is, above all, a question of a grinding or polishing tool with a polygonal shape, for example, a triangular or quadrangular shape, with the longitudinal edges extending in a straight line or being concave or convex. In accordance with FIG. 7 of the drawings, quite special edge shapes are also readily possible. Accordingly, the grinding or polishing tool very advantageously exhibits a non-circular, in particular, approximately polygonal working surface.

Another variant of the invention is characterized in that the grinding or polishing tool is arranged eccentrically in relation to the drive shaft and, in particular, is of substantially bar-shaped or strip-shaped configuration. This tool is suited, above all, for working on small and minute surfaces or on inside edges and inside corners.

Special operations can be carried out with a grinding or polishing tool which is advantageously characterized in that only the free end region of this tool comprises a grinding or polishing surface. In a further development of the invention, the free end or the free end region is angled and only the angled part comprises a grinding or polishing surface, as is apparent from FIG. 6 of the drawings. Grinding and polishing operations for which no hand tool has existed hitherto, can be mechanically performed with this tool.

In a further particularly advantageous embodiment of the inventive portable grinder, the housing extends substantially laterally in the direction away from the pivot axis, i.e., the pivot axis is, for example, located in a front gearing section of this housing and the latter then extends in one direction away from the pivot axis. This has the great advantage, particularly when working on corners, that the grinding tool can be easily introduced into any corners with a part thereof which is located opposite the housing with respect to the pivot axis. Advantageously, the corner region of the grinding tool having an angle less than 90 degrees should then be arranged in the region of the grinding tool located opposite the housing in order that the operator has a good view of it and introduction of this corner region into a corner is not impeded by the housing itself as it extends in the opposite direction with respect to the pivot axis.

In a last embodiment lying within the scope of the inventive solution, it is of advantage, in a further development of the above-mentioned embodiments, for the housing to comprise a longitudinal axis which includes approximately a right angle with the pivot axis. As a rule, in such an embodiment, the longitudinal axis of the housing will coincide with the axis of rotation of the rotating motor. Hence the axis of rotation of the rotating motor will likewise be approximately at a right angle to the pivot axis. The advantage of such an embodiment is that a particularly simple and advantageous design of the gearing which converts the rotating motion into an oscillating motion is possible.

This embodiment, furthermore, has the advantage that the housing, in particular, the part of the housing accommodating the rotating motor does not impede working in a corner since it is located approximately opposite the corner region of the grinding tool and hence awards the operator an optimal view thereof.

Finally, in accordance with the invention, it is particularly advantageous for the housing containing the rotating motor to be simultaneously designed as a handle for the operator.

Further configurations and advantages of the invention portable grinder are apparent from the following description of various embodiments.

These embodiments are illustrated in the drawings, in which.

Figure 1:
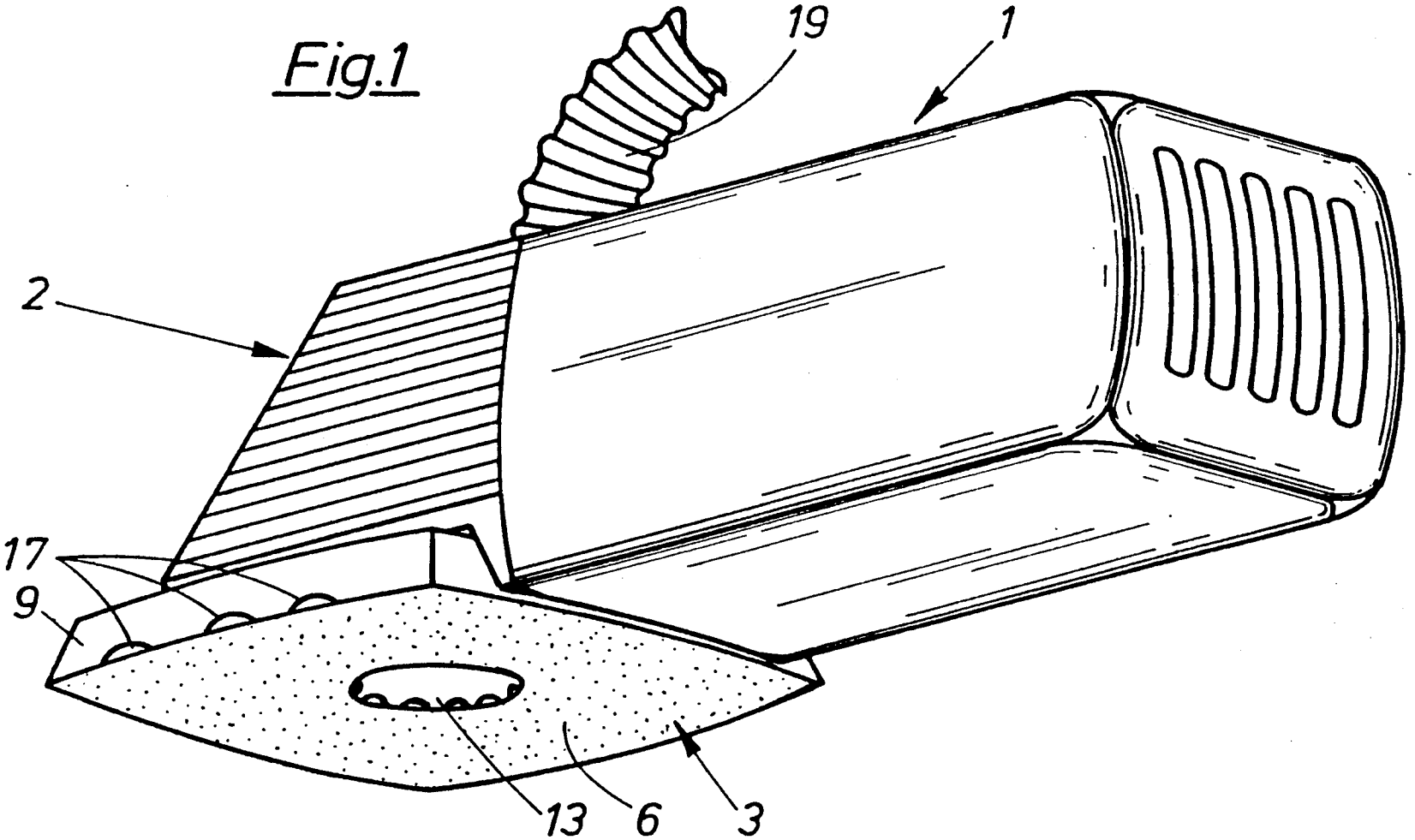
FIG. 1 is a perspective, partly broken-off view from below of a first variant of the invention.

The grinder illustrated in FIG. 1 is provided with a motor 1 accommodated in the housing. In lieu of the preferably provided electric motor, a different drive, for example, a pneumatic one is conceivable. Adjoining the motor 1 is a gearing 2 which is likewise accommodated in the housing. In the gearing 2, the rotational motion of the electric motor is converted into an oscillating motion of a grinding or polishing tool 3. More specifically, the grinding or polishing tool performs a rotational motion back and forth about the fixed geometrical axis 29 of the apparatus. The angle of rotation is preferably of the order of 0.5 degrees to 7 degrees and the frequency is, in particular, approximately ten thousand to twenty-five thousand oscillations per minute.

Figure 3:
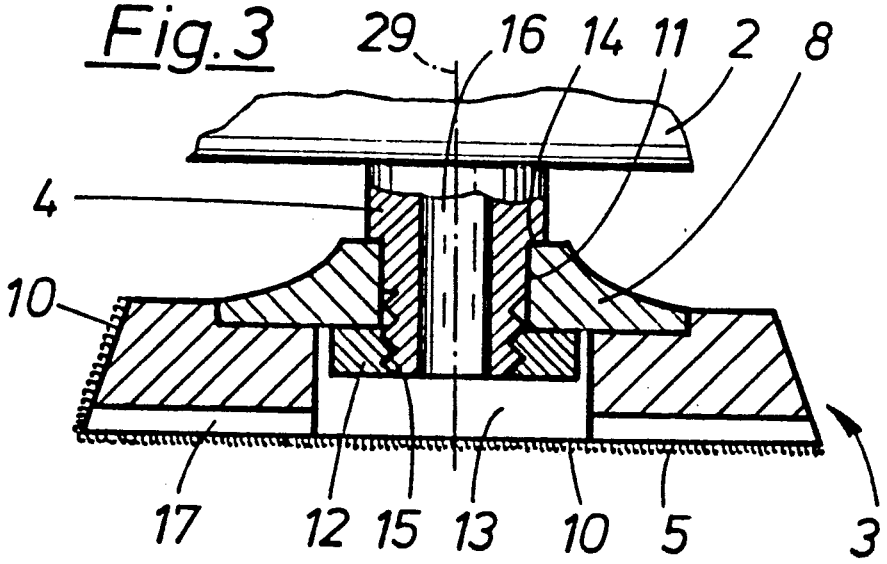
FIG. 3 is a sectional view taken on line III—III of FIG. 2 in conjunction with a broken-off and longitudinal sectional illustration of the portable grinder of FIG. 1.

In accordance with FIG. 3, the grinding and polishing tool 3, referred to hereinafter for simplicity merely as "tool 3", which should not be construed as a limitation, is connected, in particular, releasably, with the drive shaft 4 which is the output shaft of the gearing. Hence its geometrical axis 29 is a pivot fixed in relation to the apparatus, about which the tool 3 oscillates.

Figure 2:
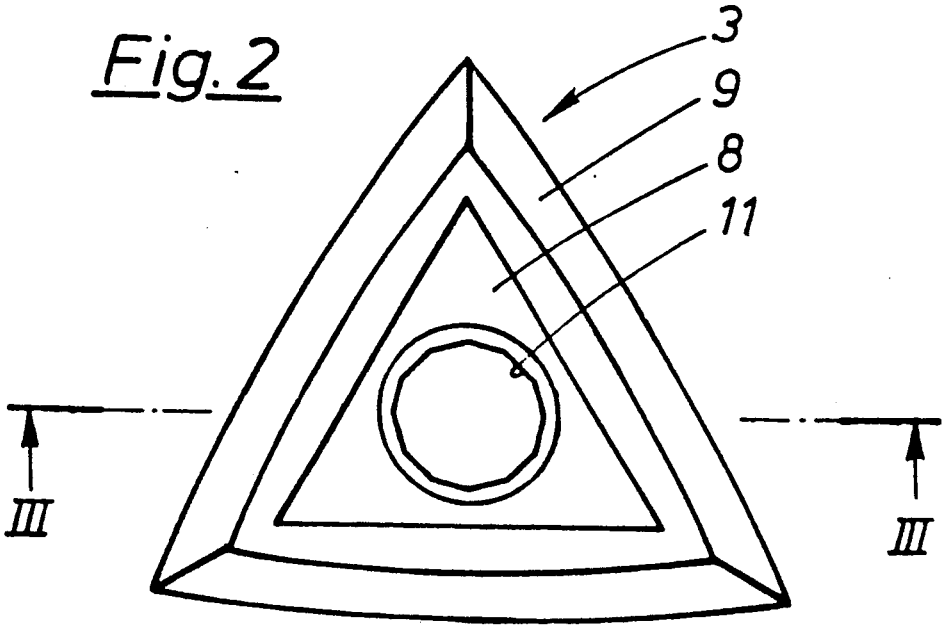
FIG. 2 is a plan view of the working surface of a grinding and polishing tool which differs from the illustration in FIG. 1.

In FIG. 1, the tool 3 comprises an approximately square-shaped working surface 5. In FIG. 2, the tool 3 is of triangular shape. With the shape shown in FIG. 2 one can reach better into corner which taper to a point. Further polygonal shapes are also conceivable for the tool 3. In many applications, a holder of elliptical shape may be used or the working surface 5 may be of bulging configuration. In the drawings, the lines joining the corner points are of arched configuration. However, to facilitate working in corners, these lines can be straight in the corner region.

Figure 4:
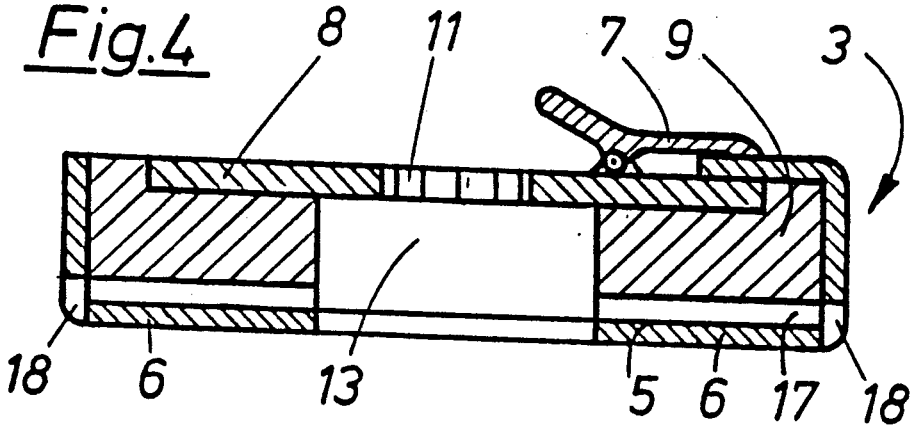
FIG. 4 is a vertical longitudinal sectional view of a third embodiment of the tool.

An abrasive paper 6 or the like may, for example, be attached to the working surface 5 of the tool 3. In accordance with the two picture halves of FIG. 4, the abrasive paper 6 may be attached by hook and loop fastening, by clips 7 or by self-adhesion.

The tool 3 consists of a dimensionally stable carrying or supporting member and a grinding or polishing element 9. The latter comprises the working surface 5 on its side facing away from the carrying or supporting member 8. An exchangeable and self-adhesive hook and loop fastening material 10 may be attached to the working surface 5 to hold an appropriate abrasive paper or the like fixed. To connect the drive shaft 4 with the tool 3, the carrying or supporting member 8 comprises an opening 11, in particular, a polygonal hole. However, the hole may also be round. A bore 13 is provided at the center of the grinding or polishing element 9 to enable a nut 12 to be fixed with the carrying or supporting member on the drive shaft 4. In this way, the drive shaft 4 can be inserted through the polygonal hole 11 until the shoulder 14 of the drive shaft 4 rests on the carrying or supporting member 8. In the region protruding through the member 8, the drive shaft 4 is designed in accordance with the polygonal hole 11 so as to provide a positive connection between drive shaft 4 and carrying or supporting member 8. The member 8 is pressed against the shoulder 14 by the nut 12 which is screwed onto the thread 15 located at the end of the drive shaft 4.

The drive shaft 4 comprises an, in particular, central bore 16 for the removal of dust by suction. In order that the dust is not removable only centrally, grooves 17 are machined in the radial direction from the bore 13, on the working surface 5 of the tool 3. To enable removal by suction from the edge, also in the FIG. 4 embodiment, holes 18 are provided in the abrasive paper or the like. There, the grinding dust is removed from the edges of the holder via the grooves 17 and/or through the bore 13 and the bore 16 of the drive shaft 4. These suction channels are connected, for example, to a suction device, not depicted, via a hose 19 attached to the gearing housing.

Figure 6:
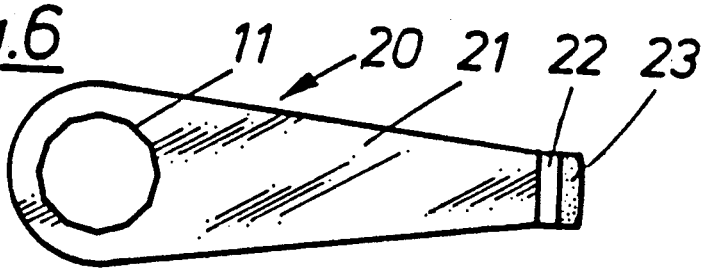
FIG. 6 is a plan view of a fourth variant of the grinding and polishing tool.

The variant shown in FIG. 6 is a grinding or polishing tool 20 which is preferably for use under particularly confined space conditions. Its clamping end is provided with a polygonal hole 11. Its rocking arm 21 is angled and comprises an attachment surface 22 carrying a grinding element 23. Only this one example is illustrated in the drawings. It is, however, clearly apparent that the grinding element 23 can be arranged in any angular position or parallel to the rocking arm 21. The length of the rocking arm 21 may be selected such that the grinding element 23 protrudes far beyond the edge of the gearing housing and hence only the narrow rocking arm 21 needs to be directed to the restricted work surface.

Figure 5:
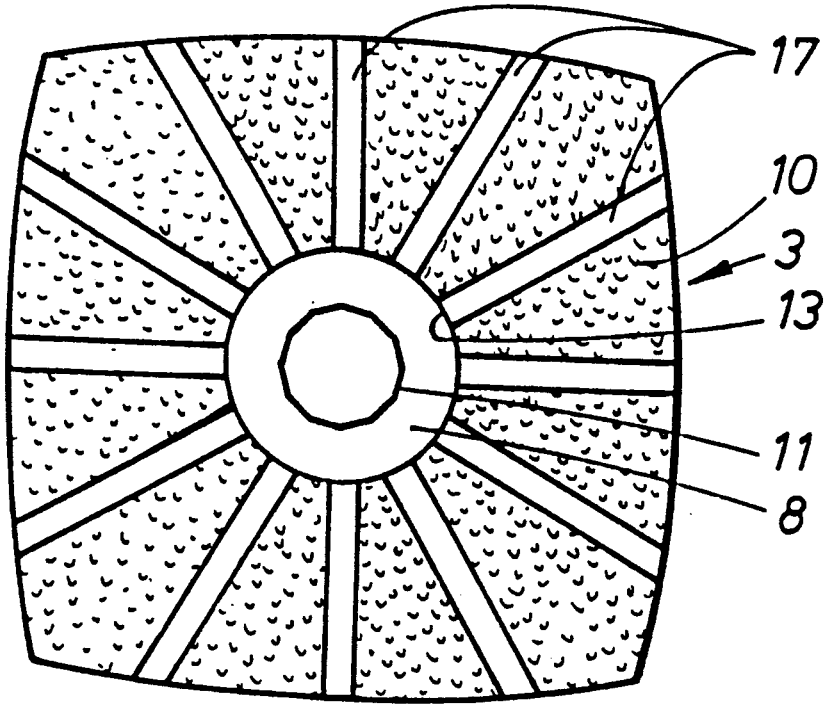
FIG. 5 is a view from below of the tool of FIG. 4.
Figure 7:
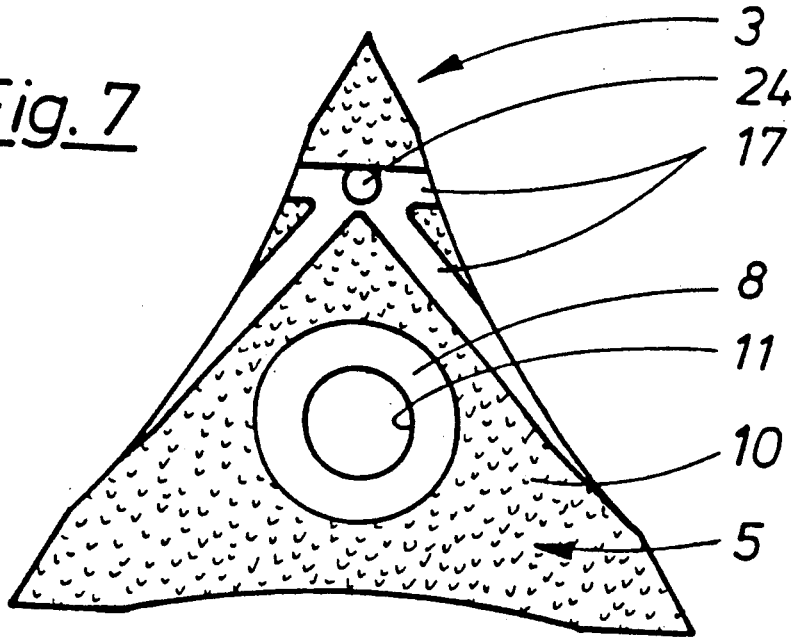
FIG. 7 is yet another view from below of a fifth embodiment of the grinding and polishing tool.

In the embodiment of FIG. 7, the working surface 5 of the tool 3 has an approximately triangular shape. Here, however, the removal by suction is not carried out centrally as in FIG. 1, but via a bore 24 provided at any point on the grinding tool 3. The grooves 17 extend towards the bore 24. By attaching the suction device to the oscillating tool 38 the grinding dust is removed as far as possible at the place where it is produced. At the same time, grinding dust is prevented from settling at the bore 24. Also shown in FIG. 7, in somewhat exaggerated illustration, is an additional possibility of joining the edges of the polygon. For polishing, a polishing paste, emulsion or the like can be advantageously introduced through the bore 24. It then spreads over the entire working surface of the polishing tool via the grooves 17. The same is applicable to the other embodiments, for example, that of FIG. 5.

Figure 8:
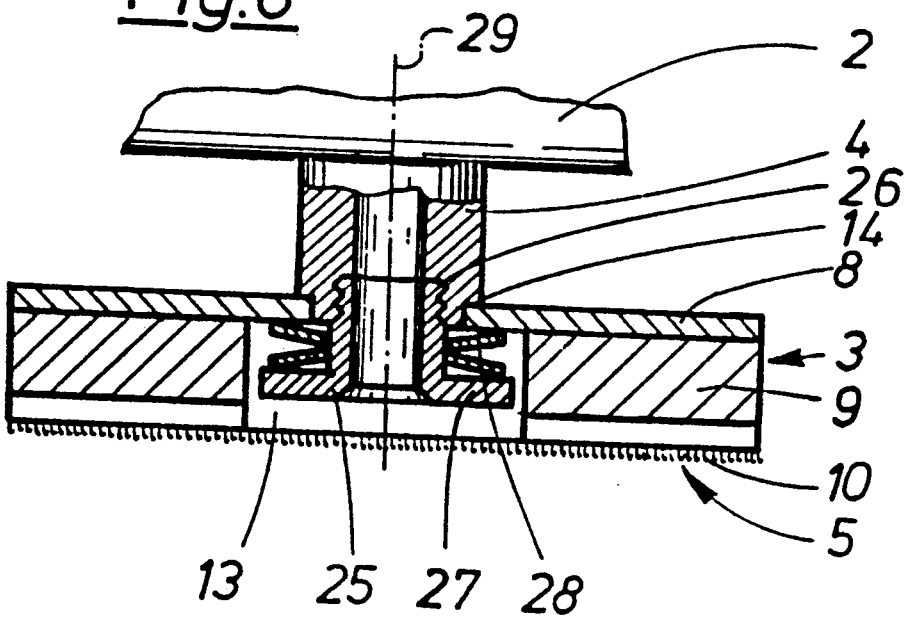
FIG. 8 is a view corresponding to FIG. 3 of the tool of FIG. 7.

An embodiment is illustrated in FIG. 8 wherein rotation of the tool 3 is possible without releasing the fixing screw 25. There is no difference in design between the holder 3 and that of FIG. 3, but, in this case, the drive shaft 4 is provided with an internal thread 26 into which the fixing screw 25 can be screwed. Before screwing-in the fixing screw 25, spring elements 28, for example, Belleville springs are inserted between the carrying or supporting member 8 and a flange 27 of the screw 25 to enable the tool 3 to be withdrawn from the shoulder 14 against the force of the spring elements 28 and rotated.

Figure 9:
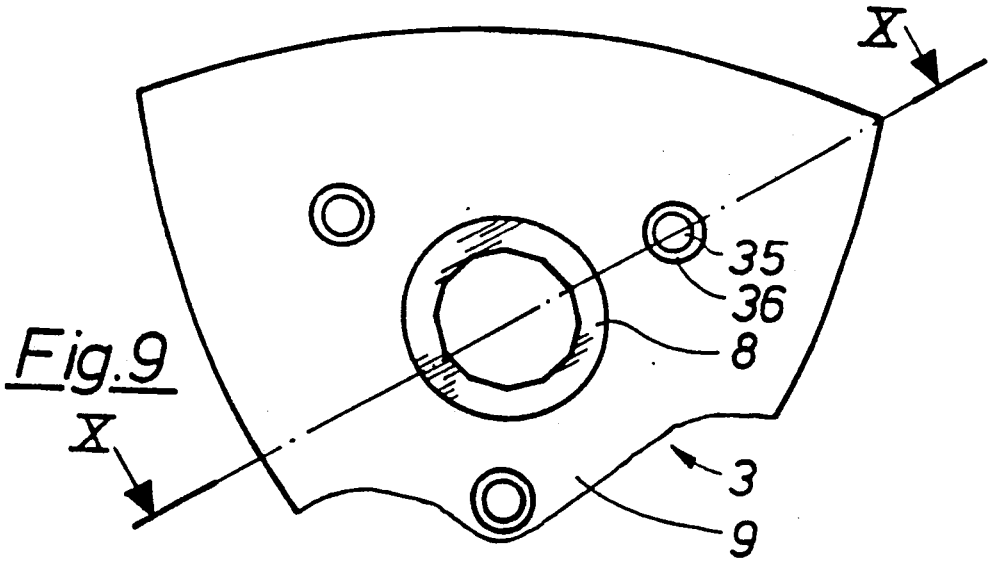
FIG. 9 is a view from below of a sixth variant of a grinding and polishing tool.
Figure 10:
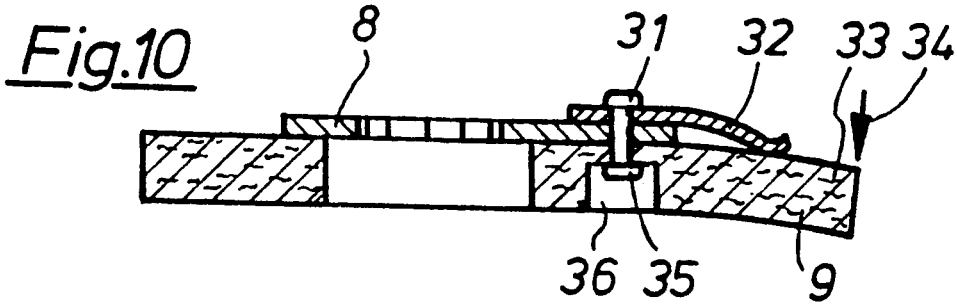
FIG. 10 is a sectional view taken on line X—X of FIG. 9.
Figure 11:
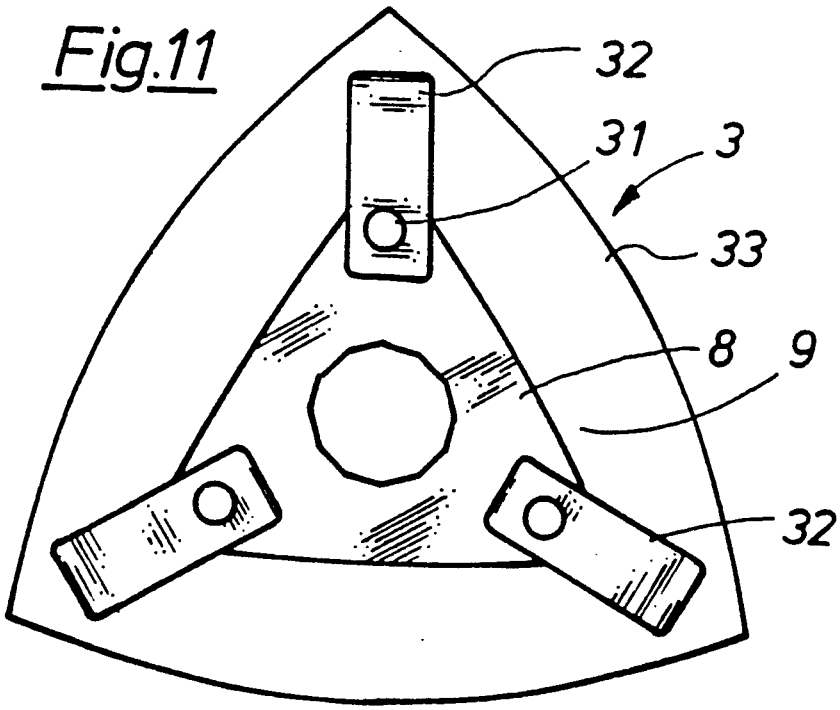
FIG. 11 is a plan view of the tool of FIG. 9.

FIGS. 9 to 11 show a further variant of a tool 3 which is primarily used as a polishing tool. This tool 3 likewise consists of a carrying or supporting member 8, for example, a metal plate (in particular, aluminum) and a grinding or polishing element 9 fixedly connected thereto. If used as a polishing element, the latter consists, for example, of felt. The connection is effected by connecting elements such as, for example, rivets 31. The latter assume an additional function, namely that of retaining a spring-elastic compression member 32 which in the embodiment is in the form of a leaf spring.

In this embodiment, the carrying or supporting member 8 and similarly the grinding or polishing element 9 are of triangular configuration with outwardly arched triangular sides. However, the carrying or supporting member 8 is considerably smaller than the grinding or polishing element 9. This results in an edge 33 protruding right around, which is acted upon in the direction of arrow 34 by the compression members 32 allocated to the corners. In this way, particularly intensive engagement of the edge, or at least of the three corner regions, is achieved. In other words, the protruding edge is thereby effectively prevented from arching-up.

The bottom rivet head 35—it could also be a screw head or a nut—pointing in the direction of the workpiece surface to be worked upon is disposed in a sunken manner in the extension 36 of the retaining bore. The remaining cavity may advantageously form a pocket for accommodation of a polishing paste or the like. The carrying or supporting member and the grinding or polishing element may, or course, also be adhered to each other or joined in another known way. In certain instances, bonding by vulcanization is also possible.

We claim:

1. A portable grinder comprising:

a housing;

a grinding or polishing tool having a first working surface with a plurality of side edges meeting to form at least one corner region having an angle less than 90°; and drive means, supported in said housing for oscillatingly moving said grinding tool; wherein regions of said grinding tool along said side edges are exposed such that the side edge regions can work along an inside longitudinal edge of a second surface along the junction of said second surface and a third surface angled thereto, with one of said side edges engaging said third surface and wherein said portions of said side edges forming said at least one corner region are straight.

2. A portable grinder as set forth in claim 1 wherein said working surface of said tool is polygonal.

3. A portable grinder as set forth in claim 1 wherein said working surface of said tool is triangular.

4. A portable grinder as set forth in claim 1 including at least two of said corner regions, wherein at least one of said side edges defines a substantially convex portion between two of said straight portions forming said at least two corner regions.

5. A portable grinder as set forth in claim 1 wherein said angle at said corner region is approximately 80°.

6. A portable grinder comprising:

a housing;

a grinding or polishing tool having a first working surface with a plurality of side edges meeting to form at least one corner region having an angle less than 90° ; and drive means, supported in said housing for oscillatingly moving said grinding tool; wherein regions of said grinding tool along said side edges are exposed such that the side edge regions can work along an inside longitudinal edge of a second surface along the junction of said second surface and a third surface angled thereto, with one of said side edges engaging said third surface, wherein said tool oscillates at a frequency between approximately 10,000 and 25,000 times per minute.

7. A portable grinder comprising:

a housing;

a grinding or polishing tool which comprises a grinder or polishing element forming a first working surface with a plurality of side edges meeting to form at least one corner region having an angle less than 90°, and a supporting member supporting the grinder or polishing element, said grinding or polishing element being removably connected to said supporting member; and drive means, supported in said housing for oscillatingly moving said grinding tool; wherein regions of said grinding tool along said side edges are exposed such that the side edge regions can work along an inside longitudinal edge of a second surface along the junction of said second surface and a third surface angled thereto, with one of said side edges engaging said third surface.

8. A portable grinder as set forth in claim 7 wherein said grinding or polishing element is flexible, and said supporting member is stiff.

9. A portable grinder as set forth in claim 8 wherein said grinding or polishing element has recesses on said working surface.

10. A portable grinder as set forth in claim 9 wherein said tool includes a suction port and said recesses in said working surface join with said suction port.

11. A portable grinder as set forth in claim 10 wherein said drive means includes a motor, and further comprising a suction fan driven by said motor and communicating with said suctio port.

12. A portable grinder as set forth in claim 10 further comprising a dust collecting container in communication with said suction port.

13. A portable grinder as set forth in claim 9 wherein said grinding or polishing element comprises a foamed material.

14. A portable grinder as set forth in claim 7 wherein said grinding or polishing element comprises felt.

15. A portable grinder as set forth in claim 7 wherein said working surface of said grinding or polishing element comprises a hook and loop fastening material.

16. A portable grinder as set forth in claim 8 wherein an edge region of said grinding or polishing element protrudes laterally beyond said supporting member, and further comprising spring means for biasing said edge region toward a surface to be worked upon.

17. A portable grinder as set forth in claim 16 further comprising a rivet connecting said spring means to said supporting member, a head of said rivet pointing in the direction of said surface to be worked upon being accommodated in a recess in said grinding or polishing element.

18. A grinding tool for a grinder with drive means for oscillatingly moving said grinding tool, comprising a working surface with a plurality of side edges meeting to form at least one corner having an angle of less than 90°, wherein regions along said side edges are exposed such that the side edge regions can work along an inside edge along the junction of two surfaces angled relative to each other and wherein the side edges are of straight-line configuration in the region of the corner.

19. Grinding tool according to claim 18, characterized in that the grinding tool comprises a polygonal working or front surface.

20. Grinding tool according to claim 19, characterized in that the front surface is in the form of a triangular surface.

21. Grinding tool according to claim 18, characterized in that the free side edges which are suitable for grinding are of convex outwardly bent configuration adjoining the region of the corner.

22. Grinding tool according to claim 18, characterized in that the angle in the corner is approximately 80°.

23. Grinding tool according to claim 18, further comprising means for mounting said grinding tool on said drive means disposed in a central region of said grinding tool.

24. A grinding tool for a grinder with drive means for oscillatingly moving said grinding tool, comprising a working surface with a plurality of side edges meeting to form at least one corner region and regions along said side edges being exposed such that the side edge regions can work along an inside edge along the junction of two surfaces angled relative to each other and having a convex outwardly bent configuration adjoining the region of the corner wherein the side edges are of straight-line configuration in the region of the corner.

25. Grinding tool as set forth in claim 24 wherein the grinding tool comprises a polygonal working or front surface.

26. Grinding tool as set forth in claim 25 wherein the front surface is in the form of a triangular surface.

27. Grinding tool as set forth in claim 24 wherein the free side edges which are suitable for grinding meet the corner region at an angle of less than 90°.

28. Grinding tool as set forth in claim 27 wherein the angle in the corner is approximately 80°.

29. Grinding tool as set forth in claim 24 wherein means for mounting grinding tool on said drive means are arranged in a central region of said grinding tool.

30. A portable grinder comprising:

a housing;

a grinding or polishing tool having a first working surface with a plurality of side edges meeting to form at least one corner region having an angle less than 90°; and drive means, supported in said housing for oscillatingly moving said grinding tool;

wherein regions of said grinding tool along said side edges are exposed such that the side edge regions can work along an inside longitudinal edge along the junction of two surfaces angled relative to each other and having a convex outwardly bent configuration adjoining said corner region, and wherein said side edges adjoining said corner are straight.

31. A portable grinder as set forth in claim 30 wherein said working surface of said tool is polygonal.

32. A portable grinder as set forth in claim 31 wherein said working surface of said tool is triangular.

33. A portable grinder as set forth in claim 30 wherein said angle between said side edges in said corner region is approximately 80°.

34. A portable grinder as set forth in claim 30 wherein said corner of said working surface protrudes beyond said housing.

35. A portable grinder comprising:

a housing;

a grinding or polishing tool having a first working surface with a plurality of side edges;

regions of said grinding tool along said side edges being exposed such that the side edge regions can work along an inside longitudinal edge along the junction of two surfaces angled relative to each other; and drive means, supported in said housing, for oscillating said grinding tool at a frequency of approximately 10,000 to 25,000 oscillations per minute 36. A portable grinder as set forth in claim 35 wherein said working surface of said tool is polygonal.

37. A portable grinder as set forth in claim 36 wherein said working surface of said tool is triangular.

38. A portable grinder as set forth in claim 35 wherein said tool comprises a grinding or polishing element forming said working surface, and a supporting member supporting said grinding or polishing element, said grinding or polishing element being removably connected to said supporting member.

39. A portable grinder as set forth in claim 38 wherein said grinding or polishing element is flexible, and said supporting member is stiff.

40. A portable grinder as set forth in claim 39 wherein said grinding or polishing element has recesses on said working surface.

41. A portable grinder as set forth in claim 40 wherein said tool includes a suction port and said recesses in said working surface join with said suction port.

42. A portable grinder as set forth in claim 41 wherein said drive means includes a motor, and further comprising a suction fan driven by said motor and communicating with said suction port.

43. A portable grinder as set forth in claim 41 further comprising a dust collecting container in communication with said suction port.

44. A portable grinder as set forth in claim 38 wherein said grinding or polishing element comprises a foamed material.

45. A portable grinder as set forth in claim 38 wherein said grinding or polishing element comprises felt.

46. A portable grinder as set forth in claim 38 wherein said working surface of said grinding or polishing element comprises a hook and loop fastening material.

47. A portable grinder as set forth in claim 39 wherein an edge region of said grinding or polishing element protrudes laterally beyond said supporting member, and further comprising spring means for biasing said edge region toward a surface to be worked upon.

48. A portable grinder as set forth in claim 47 further comprising a rivet connecting said spring means to said supporting member, a head of said rivet pointing in the direction of said surface to be worked upon being accommodated in a recess in said grinding or polishing element.

49. A portable grinder as set forth in claim 1 wherein drive means are for oscillatingly moving said grinding tool with a pivot angle of approximately 0.50° to 7°.

50. A portable grinder as set forth in claim 10 wherein said drive means includes a drive shaft supporting said tool to pivot about a pivot axis, said drive shaft being hollow and communicating with said suction port.

51. A portable grinder as set forth in claim 41, wherein said drive means includes a drive shaft supporting said tool about a pivot axis, said drive shaft being hollow and communicating with said suction port.

* * * * *